US005335375A

United States Patent [19]

Madson, Jr.

[11] Patent Number: 5,335,375

[45] Date of Patent: Aug. 9, 1994

[54] WHIRLPOOL BATH WITH A TANK WITH RECESSED SUMP

[76] Inventor: Lawrence E. Madson, Jr., 61 Lambeth Dr., Upper St. Clair, Pa. 15241

[21] Appl. No.: 145,081

[22] Filed: Nov. 3, 1993

Related U.S. Application Data

[63] Continuation-in-part of Ser. No. 12,944, Feb. 3, 1993, Pat. No. 5,289,598.

[51] Int. Cl.[5] ..... E03C 1/328

[52] U.S. Cl. ..... 4/541.1; 4/541.3; 4/541.6; 607/86

[58] Field of Search ..... 4/541.1, 541.2, 541.3, 4/541.4, 554, 592, 594, 540, 548, 546; 607/85, 86, 87

[56] References Cited

U.S. PATENT DOCUMENTS

| | | | |
|---|---|---|---|
| D. 171,018 | 12/1953 | Zoffer | 4/548 |
| 2,237,435 | 4/1941 | Ille . | |
| 2,417,499 | 3/1947 | Ille . | |
| 2,555,686 | 6/1951 | Farrelly et al. . | |
| 3,886,936 | 6/1975 | Wehrenberg | 4/546 |

FOREIGN PATENT DOCUMENTS

| | | | |
|---|---|---|---|
| 3544002 | 6/1987 | Fed. Rep. of Germany . | |
| 4038501 | 6/1992 | Fed. Rep. of Germany | 4/541.3 |
| 3158532 | 7/1991 | Japan . | |
| 105422 | 4/1917 | United Kingdom | 4/541.3 |
| 2227934 | 8/1990 | United Kingdom . | |

OTHER PUBLICATIONS

Ferno Ille Hi-Lo Jr.

*Primary Examiner*—Henry J. Recla
*Assistant Examiner*—Charles R. Eloshway
*Attorney, Agent, or Firm*—Sixbey, Friedman, Leedom & Ferguson

[57] ABSTRACT

A whirlpool bath is provided having a support frame for contact with a supporting surface. The support frame includes a support section for separately supporting a water containing tank and an impeller for selectively creating a water jet stream within the tank or pumping water from the tank. The support section is vertically adjustable to adjust the position of both the tank and the impeller relative to the support surface and the impeller is separately adjustable vertically relative to the tank. The tank is not secured to the support section, and both the tank and the impeller may be separately removed for cleaning. The tank includes a sump at one end thereof which is dimensioned to receive the impeller when water is to be pumped from the tank.

13 Claims, 2 Drawing Sheets

WHIRLPOOL BATH WITH A TANK WITH RECESSED SUMP

This application is a continuation-in-part application of my copending application Ser. No. 08/012,944 filed Feb. 3, 1993 now U.S. Pat. No. 5,289,598.

Technical Field

The present invention relates generally to whirlpool bath units which generate an aerated stream of water for use in hydrotherapy, and more particularly to an improved whirlpool bath unit which is lightweight, portable, and includes a one piece tank having a recessed sump to facilitate water removal and cleaning.

BACKGROUND OF THE INVENTION

Hydrotherapy is a recognized treatment for a number of injuries and physical disabilities, and this has led to the development of numerous whirlpool bath units for providing such treatments. Many therapeutic bath units consist of large, fixed tubs or tanks which incorporate large motor and pump units that draw water from the bottom of the tub or tank and supply the water under pressure to a number of massage jets which introduce water streams into the tub. Often, the motor also drives an air compressor which aerates the water ejected from the massage jets. Such a unit is illustrated by German Patent DE3544002A to Trabert.

In some fixed bathtub systems for generating a jet stream or bubble jet of water, a pump is provided which pumps water from the bottom of the bathtub through a fixed pipe system and back into the bathtub through water discharge ports. In systems of this type, the normal bathtub drain pipe may be connected to the output of the pump by a changeover valve which permits the pump to discharge water from the bathtub into the drain pipe. A bathtub system of this type is illustrated by Japanese Patent No. 3-158532(A).

In an attempt to develop therapeutic bath devices having some adjustability, the tub or tank employed has been provided with a motor driven impeller for creating a water jet which is vertically adjustable. U.S. Pat. Nos. 2,237,435 and 2,417,499 to Ille and 2,555,686 to Farrelly et al. are illustrative of known adjustable impellers for use with the bathtub or tank.

Although known prior art devices operate effectively to create a water jet flow within the tank or bathtub, they lack the portability and total adjustability which would be ideal for an effective hydrotherapy unit. Tubs or tanks which are fixed in place to either the plumbing of a building or a support frame can prove difficult to completely drain and clean. This is particularly true for units having an impeller which pumps a water stream through fixed ports formed in the tub or tank, as it is extremely difficult to effectively clean and disinfect such ports and the conduits leading thereto.

BRIEF DESCRIPTION OF THE INVENTION

It is a primary object of the present invention to provide a novel and improved whirlpool bath with a one piece tank having no openings in the tank bottom on sidewalls wherein the tank includes a recessed sump to enhance water removal and cleaning.

Another object of the present invention is to provide a novel and improved whirlpool bath with removable tank wherein both the tank and a combined impeller and water discharge pump are separately and removably mounted upon a support frame. This permits both the tank and the impeller to be separately removed from the support frame and separately cleaned and disinfected.

A further object of the present invention is to provide a novel and improved whirlpool bath with removable tank wherein the tank unit is formed as a solid unitary member with no water inlet openings to accumulate dirt or bacteria containing residue. The tank is mounted for vertical adjustment on a portable mounting frame, and may be easily removed from the frame for separate cleaning.

Yet another object of the present invention is to provide a novel whirlpool bath with removable tank wherein the tank is removably mounted on a horizontal support seat which constitutes a portion of a portable support frame. The horizontal support seat is vertically adjustable to adjust the height of the tank relative to a support surface, and a separate impeller unit for creating a water jet within the tank is separately mounted upon the support frame. The impeller unit is not connected to the tank in any manner and is removably mounted upon the support frame for separate vertical adjustment relative to the tank, and support frame. However, the impeller unit also moves vertically with the tank and horizontal support seat.

Yet a further object of the present invention is to provide a novel and improved whirlpool bath with removable tank wherein the bottom surface of the tank is formed with indented channels to receive segments of a horizontal support frame so that the tank is retained against sliding movement relative to the support frame. However, the channels are open so that the tank may be lifted vertically and removed from the support frame.

Another object of the present invention is to provide a novel and improved whirlpool bath with removable tank wherein a unitary tank is removably mounted upon a horizontally extending seat which constitutes a portion of a portable support frame. The support seat is vertically adjustable relative to a supporting surface for the support frame so that the height of the tank may be adjusted. A combined impeller and discharge pump unit is removably mounted as a separable unit on the support frame and is also vertically adjustable relative to the tank.

A still further object of the present invention is to provide a novel and improved whirlpool bath with removable tank having a combined impeller and discharge pump unit removably mounted on a support frame for the removable tank. A recessed sump is formed in the bottom of the tank and positioned to receive the impeller head of the combined impeller and discharge unit. The sump is formed to contain a volume of fluid which would remain in a flat bottomed tank in the space between the tank bottom and the impeller blades.

BEST MODE FOR CARRYING OUT THE INVENTION

Figure 1:
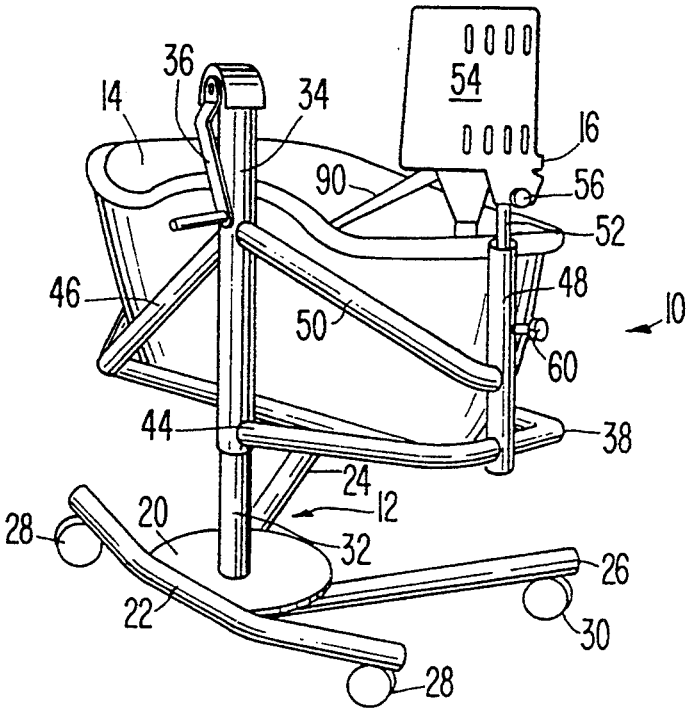
FIG. 1 is a perspective view of the whirlpool bath with removable tank of the present invention.

The whirlpool bath with removable tank of the present invention indicated generally at 10 includes a portable support frame 12 which separately supports a unitary tank 14 and a combined impeller and discharge pump 16. The unitary tank 14 may be formed of metal, but is preferably molded of a tough, stain resisting plastic which is both lightweight and facilitates easy cleaning. The tank may include a drain opening in the bottom thereof, shown in broken lines at 18 in FIG. 3, but preferably the tank is formed with a unitary bottom and sidewall having no openings to collect dirt and residue. Continuous inner surfaces of the tank may be easily cleaned and disinfected since the tank is formed with no openings and no sharp corners, but instead, the bottom wall is rounded into the sidewalls which in turn are rounded or curved to form the tank enclosure.

The portable support frame 12 includes a base 20 from which support legs 22, 24 and 26 radiate. Support leg 22 is a curved leg which is connected to the base and extends across one side thereof and outwardly from opposite sides of the base. Rollers or casters 28 are mounted at each end of the support leg 22.

Support legs 24 and 26 arc each secured at one end to the base 20 and extend angularly outward therefrom to form a substantially V shaped support opposite to the support leg 22. The outermost ends of the support legs 24 and 26 bear casters or rollers 30, one of which is shown in FIG. 1.

Projecting vertically from the base 20 is a central support post 32 which extends in telescoping relationship into a hollow frame post 34. The frame post 34 is moved upwardly or downwardly along the central support post 32 by rotation of a manually operative crank 36 mounted at the top of the frame post 34. Operation of the crank causes a known mechanism within the frame post to raise or lower the frame post relative to the central support post 32. For example, the crank 36 can turn an internal gear pair which in turn drive an elongated threaded screw shaft threaded into a corresponding threaded opening in the central support post 32. Other known mechanisms for raising or lowering the frame post 34 might include a gas cylinder and piston within the frame post wherein the piston engages the central support post 32 and actuation of the crank 36 causes gas or fluid to be pumped into or out of the cylinder to extend or retract the piston.

The frame post 34 supports a horizontally extending mounting seat 38 which is configured to receive and support the bottom wall 40 of the tank 14. Basically, the horizontal mounting seat consists of a somewhat rectangular shaped closed length of metal tubing which extends around the periphery of a central open space 42 defined thereby which is covered by the tank bottom when the bottom is supported upon the horizontal mounting seat. A first support strut 44 is secured at one end to the frame post 34 and at the opposite end to the innermost side of the horizontal mounting seat which is adjacent to the frame post. A second support strut 46 is connected at one end to the frame post and angles downwardly therefrom to a point of connection with the rear side of the horizontal mounting seat.

A hollow impeller support post 48 is secured at one end to the center of the front portion of the horizontal mounting seat 38 and extends vertically upward therefrom. A third support strut 50 is secured at one end to the frame post 34 and angles downwardly therefrom to an opposite end which is secured to the impeller support post 48. The uppermost end of the impeller support post is open and receives in telescoping relationship a post 52 connected to the motor 54 for the impeller and discharge pump 16. The upper end of the post 52 extends into an opening in the housing for the motor 54 and is removably secured in the opening by a threaded screw shaft operated by a locking knob 56.

Figure 2:
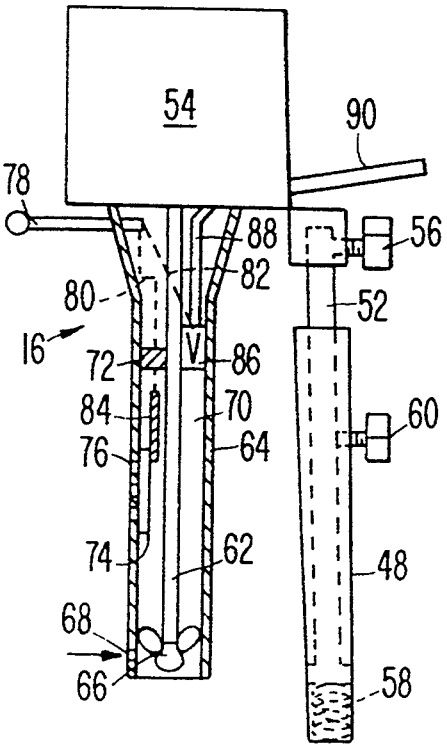
FIG. 2 is a partially sectioned diagrammatic view of the combined impeller and discharge pump of FIG. 1.

The construction and operation of the combined impeller and discharge pump 16 may best be understood with reference to FIG. 2, wherein it will be noted that the post 52 extends inwardly of the impeller support post 48 and is biased outwardly therefrom by a biasing member 58. In FIG. 2, the biasing member is illustrated as a spring which tends to force the post 52 upwardly and out of the impeller support post 48. However, instead of the spring, gas or fluid under pressure may be used in known manner as the biasing member 58. The biasing member tends to assist in raising the combined impeller and discharge pump so that it may be easily adjusted upwardly to any desired vertical position and then locked in place by a threaded screw shaft operated by a lock knob 60. To lower the impeller and discharge pump, downward pressure is applied to the motor 54 to move the post 52 inwardly of the impeller support post 48 to a desired position against the bias of the biasing member 58, and when the desired position is reached, the lock knob 60 is rotated to lock the post in place.

The motor 54 drives an elongated drive shaft 62 which extends centrally through an elongated housing 64 secured to the motor. At the end of the drive shaft within the housing are impeller blades 66 which operate when driven by the drive shaft to draw water into the housing 64 through water inlet openings 68. This water is forced under pressure by the impeller into a chamber 70 formed in the lower portion of the housing 64 and defined by an upper wall 72. Normally, since water cannot pass by the upper wall 72, it is forced under pressure through an aerator 74 and then out through the outlet ports 76. Thus jet streams of pressurized aerated water are forced out of the ports 76 and back into the tank 14. The position of these jets within the tank can be adjusted by adjusting the vertical position of the post 42 relative to the impeller support post 48.

At the end of a hydrotherapy treatment, the combined impeller and discharge pump 16 may be employed to eject water from the tank 14. This is accomplished by operating a control mechanism, shown in FIG. 2 as a lever and knob 78 connected by linkages 80 and 82 to a gate closure 84 and a valve 86, respectively. The lever and knob 78 may be operated through the linkage 80 to cause the gate 84 to close the flow path through the aerator 74 and the outlet ports 76, and at the same time, causing the linkage 82 to open the valve 86. Now fluid pumped into the chamber by the impeller blades 66 will pass through the valve 86 and a conduit 88 to an external fluid discharge nozzle 90. The fluid discharge nozzle may be placed in a sink or drain which will receive the fluid from the tank 14.

Obviously, other known mechanical combinations can be employed to prevent fluid flow through the outlet ports 76 while permitting fluid flow to the discharge nozzle 90. A series of valves operated by a single controller or by separate controllers can be employed for this purpose. The lever and knob controller 78 can be linked to raise or lower the gate 84 to some extent before the linkage 82 to the valve 86 is activated. This will permit the lever and knob controller to decrease or increase the fluid flow to the aerator 74 and thereby control the pressure and the amount of fluid flow out through the outlet ports 76.

Since the tank 14 and the combined impeller and discharge pump 16 are not interconnected but are separately mounted upon the portable support frame 12, both may be independently adjusted. For example, by operation of the crank 36, the tank on the horizontal mounting seat 38 as well as the impeller and discharge pump may be moved to a desired vertical position. Then subsequently, the combined impeller and discharge pump may be adjusted to a new vertical position relative to the tank with the assistance of or against the bias of the biasing member 58 and then may be locked into position with the lock knob 60. However, as a hydrotherapy treatment progresses, the combined impeller and discharge pump may be easily repositioned a number of times to achieve a maximum effect without the necessity of repositioning the tank 14. When a treatment is complete, water may be easily discharged from the tank 14 through the discharge nozzle 90, and then, by lowering the horizontal mounting seat 38 to its lowermost position while raising the combined impeller and discharge pump 16 to its uppermost position, the tank can be lifted from the horizontal mounting seat and removed clear of the combined impeller and discharge pump for separate cleaning and disinfecting. If desired, by operating the locking knob 56, the impeller and discharge pump can be removed from the post 52 for separate cleaning and disinfecting.

Normally, the tank 14 rests firmly on the horizontal mounting seat 38 with the bottom of the tank 40 spanning the rectangular tubular support provided by the horizontal mounting seat, and the weight of the water in the tank causes the tank to be firmly mounted. Although the horizontal mounting seat and the tank extend outwardly from one side of the central support post 32, the design of the base provides a very stable support for the tank 14. This support is enhanced by the leg 22 which extends beneath and substantially parallel to the longitudinal axis of the tank 14 so that the casters 28 are positioned at least beneath the opposed ends of the tank and preferably outward of the opposed tank ends. Similarly, the angled support legs 24 and 26 extend for a distance wherein the casters 30 are positioned at opposite ends of the tank 14 and at least under the front portion 92 of the horizontal mounting seat and preferably outwardly thereof. By positioning the tank and horizonal mounting seat on one side of the frame post 34 and by angling the support legs 24 and 26 outwardly beneath the horizontal mounting seat, free, substantially unimpaired access is provided to the outermost side of the tank. It is possible to slide the horizontal mounting seat over a stool, chair, table or similar unit.

Figure 3:
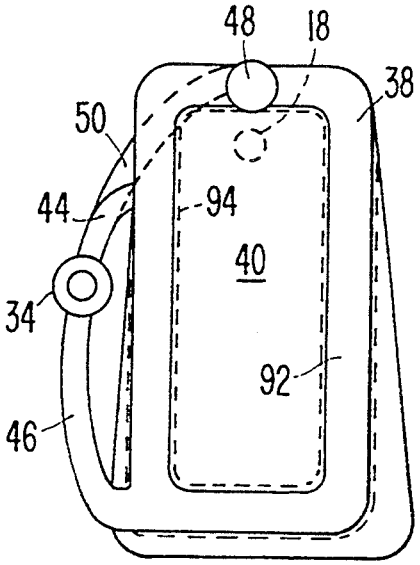
FIG. 3 is a bottom plan view of the tank and support frame of FIG. 1.

Although the weight of the water in the tank normally mounts the tank against movement on the horizontal mounting seat, to positively assure that no shifting of the tank relative to the mounting seat can occur, indented channels indicated in broken lines at 94 in FIG. 3 may be formed in the bottom wall 40 of the tank so that the horizontal mounting seat extends into these channels. The channels will be open at the bottom of the tank so that the tank may be easily lifted from the horizontal mounting seat. These channels accurately position the tank on the mounting seat relative to the impeller for the purpose to be subsequently described.

Figure 4:
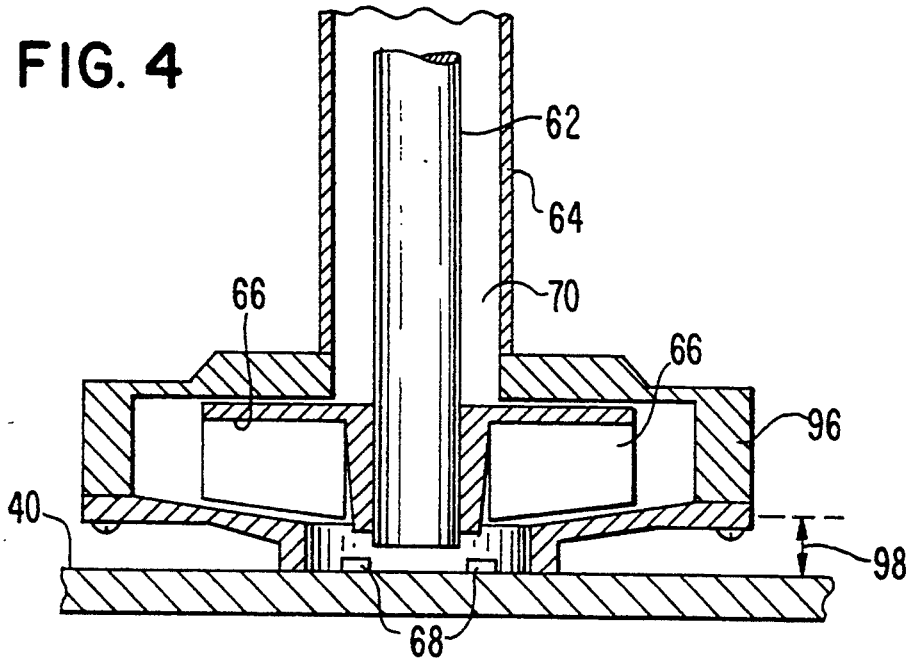
FIG. 4 is a sectional view of the impeller head for the combined impeller and discharge pump of FIG. 1.
Figure 5:
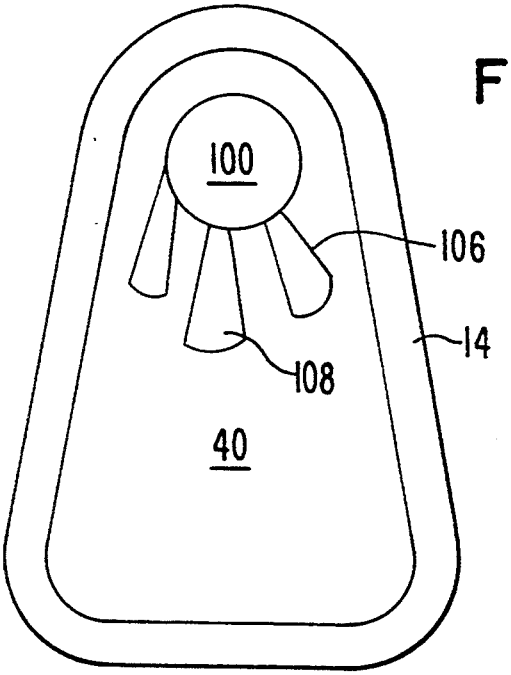
FIG. 5 is a top plan view of a second embodiment of the tank of FIG. 1.

Referring now to FIG. 4, it will be noted that the lower end of the housing 64 for the impeller and discharge pump 16 normally terminates in an enlarged impeller blade housing section 96 which houses the impeller blades 66. The impeller blades are spaced above the bottom wall 40 for the tank 14 when the impeller blade housing 48 contacts the bottom wall, for the water inlet openings 48 are positioned below the impeller blades. Once the water level in the tank drops below the impeller blades into the area indicated at 98, the impeller will no longer effectively discharge water through the fluid discharge nozzle 90, and a layer of water which is often one to two inches in depth will remain in the tank 14. The practice has been to sponge this water from the tank by hand before the tank is reused or removed from the support frame 12 for further cleaning, and with large tanks, this is a time consuming process.

To alleviate the problem caused by residual water in the tank 14 after operation of the impeller and discharge pump 16 in the impeller mode, the bottom wall 40 of the tank is formed with a recessed sump 100 which is positioned directly under the enlarged impeller blade housing section 96. Since the impeller and discharge pump 16 is positively positioned on the support frame 12 by the impeller support post 48 while the tank 14 is positively positioned on the support frame 12 by the horizontally extending mounting seat 38, it is possible to position and dimension the sump 100 to provide a close tolerance with the enlarged impeller blade housing section. This positive positioning of the tank is enhanced in tanks having channels 94 formed in the bottom wall 40 thereof.

Figure 6:
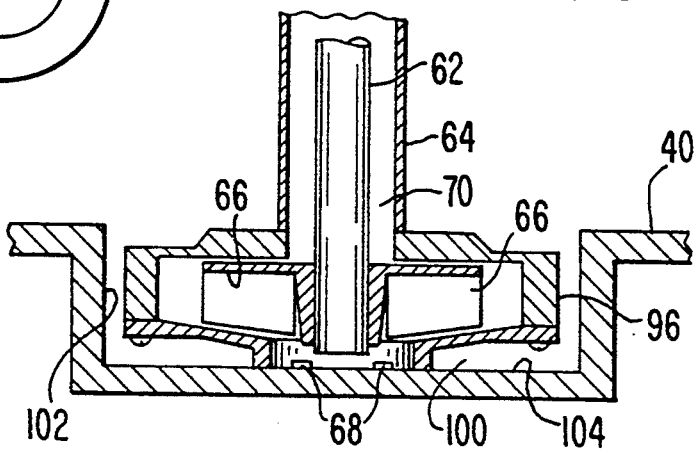
FIG. 6 is a sectional view of the impeller head and tank sump for the tank of FIG. 5.

Ideally, the sump 100 is designed with sidewalls 102 that are spaced closely adjacent to the outer surface or the impeller blade housing section when the impeller blade housing section is inserted into the sump as shown by FIG. 6. This minimizes the surface area of the sump bottom wall 104 upon which an inch or two of water will remain when the impeller finishes discharging water through the fluid discharge nozzle 90. The depth of the sump, which is determined by the distance of the sump bottom wall 104 below the tank bottom wall 40, is preferably designed so that the sump can contain the volume of water which would normally be left in the area 98 of the tank when no sump is provided. In designing the tank, the most desirable sump volume can be determined by multiplying the area A of the bottom wall 40 by the depth D of the space 98 to determine the volume necessary to receive the water left in the tank. Then the depth of the sidewall 102 is determined by dividing this desired volume by the area of the bottom wall 104 which is necessary to closely space the sidewall 102 to the outer surface of the blade housing section 96. By doing this, the surface area of the bottom wall 104 of the sump 100 will be minimized, and the inch or two of water which remains on this sump bottom wall after operation of the impeller and discharge pump 16 to remove water from the tank can be easily and quickly sponged up.

Ideally, the sump 100 must be deep enough so that when the blade housing section contacts the sump bottom wall 104, the impeller blades 66 are below the level of the bottom wall 40 of the tank 14 as shown in FIG. 6. This insures that the bottom wall 40 will be pumped substantially dry by the impeller and discharge pump 16. This is particularly important for very large tanks where it is not practical to form the sump 100 to a depth sufficient to hold all of the residual water on the tank bottom 40. With this construction, water will continue to flow into the sump to replenish the water pumped from the sump until the bottom wall 40 of the tank is substantially dry. To aid in this flow of water to the sump, the tank bottom wall can be formed with shallow channels 106 having bottom walls 108 which are inclined upwardly away from the edge of the sump 100. Alternatively, the entire tank bottom wall 40 in the area of the sump could be inclined downwardly toward the sump, or the mounting seat 38 can be inclined slightly to raise the end of the tank 14 which is opposite to the sump end slightly above the sump end.

For normal operation of the impeller and discharge pump 16 to force water under pressure through the aerator 74 and out through the outlet ports 76, the post 52 is positioned relative to impeller support post 48 so that the impeller blades 66 are above the bottom 40 of the tank 14. When water is to be ejected from the tank, the impeller and discharge pump is lowered until the bottom of the enlarged housing section 96 contacts the bottom wall 104 of the sump 100 as shown in FIG. 6.

INDUSTRIAL APPLICABILITY

The whirlpool bath with removable tank of the present invention provides an effective portable, adjustable hydrotherapy unit which may be easily cleaned and disinfected after use. The height of the tank above a support surface for the bath may be adjusted without altering the relationship between the tank and an impeller for creating water jets within the tank. Once the tank position is set, the vertical position of the impeller relative to the tank can be adjusted without altering the relationship between the tank and the support surface. The tank and tank supporting frame are designed so that the tank is provided with stable support during use while facilitating unimpaired access to one side of the tank. Both the tank and the impeller are separately removable from the frame for cleaning.

I claim:

1. A whirlpool bath comprising:

a support frame for resting on a support surface, said support frame including a support section and means for raising or lowering said support section relative to said support surface, a tank for containing water removably supported on said support section but not attached thereto, said tank having a tank bottom wall and a water receiving sump formed adjacent to one end of said tank bottom wall and being recessed below said tank bottom wall, impeller means for creating a stream of water under pressure in said tank and including a water discharge system and an external discharge nozzle connected to said water discharge system, said impeller means including an impeller head section for immersion in water contained in said tank and being operative alternatively to either create a stream of water under pressure in said tank or to pump water from said tank through said water discharge system to said external discharge nozzle, and said support frame having impeller mounting means thereon for separately and removably mounting said impeller means on said support section to extend into said tank with said impeller head section in alignment with said water receiving sump, said impeller mounting means operating to permit said impeller means to be raised or lowered relative to both said support section and tank and to permit said impeller head section to be inserted into said water receiving sump, said tank and said impeller means being independently removable from said support section.

2. The whirlpool bath of claim 1 wherein said water receiving sump opens into said tank and includes a sump bottom wall and a sidewall which spaces said sump bottom wall beneath said tank bottom wall, said sump sidewall being dimensioned to permit said impeller head section to be inserted into said water receiving sump with said impeller head section spaced from but closely adjacent to said sump sidewall.

3. The whirlpool bath of claim 1 wherein said impeller means includes impeller blades mounted in said impeller head section, said water receiving sump being recessed below said tank bottom wall to a depth sufficient to permit said impeller head section to be inserted into said sump to position said impeller blades in said sump below the level of said tank bottom wall.

4. The whirlpool bath of claim 1 wherein said tank bottom wall includes at least one wall portion which is inclined downwardly toward said water receiving sump.

5. The whirlpool bath of claim 4 wherein a plurality of channels are formed in said tank bottom wall which extend to said water receiving sump, said channels each having a channel bottom wall which is inclined downwardly toward said water receiving sump.

6. The whirlpool bath of claim 1 wherein said tank bottom wall includes open channels to engage and receive said support section to prevent said tank from sliding relative to said support section while permitting removal of said tank from said support section.

7. A whirlpool bath comprising:

a support frame for resting on a support surface, a tank for containing water mounted on said support frame, said tank having a tank bottom wall and a water receiving sump formed adjacent to one end of said tank bottom wall and being recessed below said tank bottom wall, impeller means for creating a stream of water under pressure in said tank and including a water discharge system, said impeller means including an impeller head section for immersion in water contained in said tank and being operative to either create a stream of water under pressure in said tank or to pump water from said tank through said water discharge system, and said support frame having impeller mounting means thereon for mounting said impeller means to extend into said tank with said impeller head section in alignment with said water receiving sump, said impeller mounting means operating to permit said impeller means to be raised or lowered relative to said support section and tank to permit said impeller head section to be inserted into said water receiving sump.

8. The whirlpool bath of claim 7 wherein said water receiving sump opens into said tank and includes a sump bottom wall and a sidewall which spaces said sump bottom wall beneath said tank bottom wall, said sump sidewall being dimensioned to permit said impeller head section to be inserted into said water receiving sump with said impeller head section spaced from but closely adjacent to said sump sidewall.

9. The whirlpool bath of claim 7 wherein said impeller means includes impeller blades mounted in said impeller head section, said water receiving sump being recessed below said tank bottom wall to a depth sufficient to permit said impeller head section to be inserted into said sump to position said impeller blades in said sump below the level of said tank bottom wall.

10. The whirlpool bath of claim 7 wherein said tank bottom wall includes at least one wall portion which is inclined downwardly toward said water receiving sump.

11. The whirlpool bath of claim 7 wherein a plurality of channels are formed in said tank bottom wall which extend to said water receiving sump, said channels each having a channel bottom wall which is inclined downwardly toward said water receiving sump.

12. The whirlpool bath of claim 11 wherein said tank bottom wall includes open channels to engage and receive said support section to prevent said tank from sliding relative to said support section while permitting removal of said tank from said support section.

13. A whirlpool bath comprising:

a support frame for resting on a support surface, said support frame including a support section and means for raising or lowering said support section relative to said support surface, a tank for containing water mounted on said support section, said tank having a tank bottom wall and a water receiving sump formed adjacent to one end of said tank bottom wall, said water receiving sump opening into said tank but being recessed below said tank bottom wall and including a sump bottom wall and a sidewall which spaces said sump bottom wall beneath said tank bottom wall, impeller means for creating a stream of water under pressure in said tank and including a water discharge system, said impeller means including an impeller head section for immersion in water contained in said tank and being operative selectively to either create a stream of water under pressure in said tank or to pump water from said tank through said water discharge system, and said support frame having impeller mounting means thereon for mounting said impeller means on said support frame to extend into said tank with said impeller head section in alignment with said water receiving sump, said water receiving sump being dimensioned to receive said impeller head section.

* * * * *